US006601934B1

(12) United States Patent
DeBusschere et al.

(10) Patent No.: US 6,601,934 B1
(45) Date of Patent: Aug. 5, 2003

(54) STORAGE OF TOTAL INK DROP FIRED COUNT IN AN IMAGING DEVICE

(75) Inventors: Eric Todd DeBusschere, Lexington, KY (US); David Nolan Mattingly, Lexington, KY (US); Stephen Kelly Cunnagin, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/074,434

(22) Filed: Feb. 11, 2002

(51) Int. Cl.[7] ..... B41J 2/195
(52) U.S. Cl. ..... 347/7
(58) Field of Search ..... 347/7, 43; 399/25, 399/27

(56) References Cited

U.S. PATENT DOCUMENTS

| | | | | |
|---|---|---|---|---|
| 5,068,806 A | | 11/1991 | Gatten | 395/113 |
| 5,414,452 A | | 5/1995 | Accatino et al. | 347/7 |
| 5,610,635 A | | 3/1997 | Murray et al. | 347/7 |
| 5,691,750 A | | 11/1997 | Edwards | 347/7 |
| 5,694,156 A | | 12/1997 | Hoisington et al. | 347/7 |
| 5,788,388 A | | 8/1998 | Cowger et al. | 400/703 |
| 5,812,156 A | | 9/1998 | Bullock et al. | 347/19 |
| 5,850,237 A | | 12/1998 | Slade | 347/23 |
| 5,966,144 A | | 10/1999 | Edwards | 347/7 |
| 6,000,773 A | | 12/1999 | Murray et al. | 347/7 |
| 6,019,449 A | | 2/2000 | Bullock et al. | 347/14 |
| 6,039,430 A | | 3/2000 | Helterline et al. | 347/19 |
| 6,065,824 A | | 5/2000 | Bullock et al. | 347/19 |
| 6,126,265 A | | 10/2000 | Childers et al. | 347/23 |
| 6,145,947 A | * | 11/2000 | Inora et al. | 347/7 |
| 6,151,039 A | | 11/2000 | Hmelar et al. | 347/7 |
| 6,155,664 A | | 12/2000 | Cook | 347/7 |
| 6,158,850 A | | 12/2000 | Cook | 347/85 |
| 6,161,913 A | | 12/2000 | Childers et al. | 347/19 |
| 6,188,413 B1 | | 2/2001 | Kang | 347/7 |
| 6,196,651 B1 | | 3/2001 | Zuber et al. | 347/7 |
| 6,196,663 B1 | | 3/2001 | Wetchler et al. | 347/43 |
| 6,227,643 B1 | | 5/2001 | Purcell et al. | 347/19 |

* cited by examiner

*Primary Examiner*—Craig Hallacher
(74) *Attorney, Agent, or Firm*—Taylor & Aust PC

(57) ABSTRACT

A method of providing a number approximating a total number of ink drops fired by an imaging device, including the steps of incrementing a COUNT variable associated with a color of ink if an ink drop of that color is fired by a printhead in the imaging device, evaluating the value of the COUNT variable and incrementing a TOTAL INK CONSUMED variable associated with the color, dependent upon the evaluating step.

22 Claims, 3 Drawing Sheets

STORAGE OF TOTAL INK DROP FIRED COUNT IN AN IMAGING DEVICE

BACKGROUND OF THE INVENTION

1. Field of the Invention

The present invention relates to an imaging system, and, more particularly, to the storage of the total ink drops fired in an imaging device.

2. Description of the Related Art

Ink jet printing involves the ejection of tiny ink drops through small nozzles in a controlled manner to create a desired image. Ink is supplied from an ink reservoir to a print head, which includes various passageways from the reservoir to the nozzle orifices. Energy is applied to the ink from an ink droplet generator near each orifice, which may include the application of electrostatic attraction, the application of oscillating forces from piezo-electric elements, the application of heat from heating elements or the like.

It is known for ink jet printers to monitor either by actual measurement or by estimation methods the amount of ink used from a printhead. This measurement or estimate of the amount of ink used by a printhead is used by the printer to estimate the remaining amount of ink in the printhead, which is sometimes displayed to indicate the ink supply status or to indicate a low ink supply. A disadvantage of this arrangement is that the information gathered relates to the use of a single printhead.

Various methods are used to gather information for sales and marketing relative to the consumption of printheads and use of printers. However, such approaches are based upon sales data and may not be based upon actual usage of printhead cartridges in printers.

What is needed in the art is a way to determine, from an ink jet printer, the ink usage data for the entire life of the printer.

SUMMARY OF THE INVENTION

The present invention provides a method and an apparatus for obtaining and storing the total ink drop fired count for an imaging device over the life of the imaging device.

The invention comprises, in one form thereof, a method for providing a number approximating a total number of ink drops fired by an imaging device, including the steps of incrementing a COUNT variable associated with a color of ink if an ink drop of that color is fired by a printhead in the imaging device, evaluating the value of the COUNT variable and incrementing a TOTAL INK CONSUMED variable associated with the color, dependent upon the evaluating step.

An advantage of the present invention is that the total ink usage through an ink jet printer is compiled and saved in an imaging device.

Another advantage is the implementation of the present invention will provide both marketing and printer usage information not currently available.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
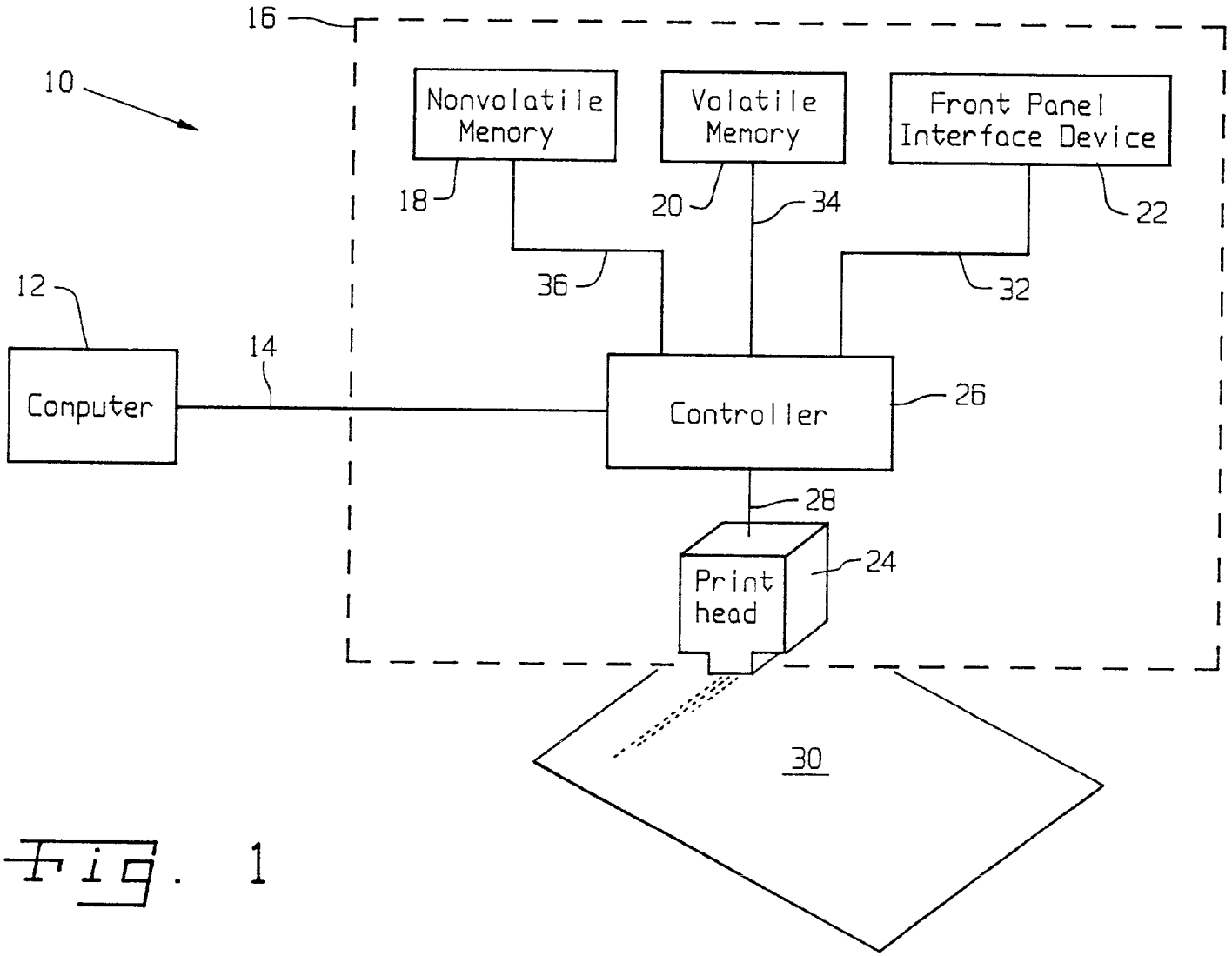
FIG. 1 is a block diagram of an imaging system embodying the present invention.

Referring now to the drawings, and particularly to FIG. 1, there is shown a host based imaging system 10 that includes computer 12, interface cable 14 and imaging device 16. Computer 12 is communicatively connected with imaging device 16 by way of interface cable 14 thereby providing communications between computer 12 and imaging device 16. Of course, appropriate I/O ports may be provided on computer 12 and imaging device 16.

Imaging device 16, which is an ink jet printer in the embodiment shown, includes nonvolatile memory 18, volatile memory 20, front panel interface device 22, printhead 24, controller 26 and interconnections 28, 32, 34 and 36.

Nonvolatile memory 18 may be, for example, electrically erasable programmable read only (EEPROM), read/write compact disk read only memory (CDROM), a floppy disk, a hard disk or flash memory. Nonvolatile memory 18 is communicatively connected to controller 26 by way of interconnection 36.

Volatile memory 20 only has storage capability when power is available to imaging device 16; when electrical power is lost volatile memory 20 loses the information stored therein. Volatile memory 20 may consist of, for example, CMOS random access memory (RAM) or any other type of memory requiring power for data retention. Volatile memory 20 is communicatively connected to controller 26 by way of interconnection 34.

Front panel interface device 22 is located on an accessible portion of imaging device 16 providing a user interface for setting parameters of imaging device 16 or receiving information from imaging device 16 and providing the information in a user readable form. Front panel interface device 22 is interconnected with controller 26 by way of interconnection 32.

Printhead 24 contains an ink reservoir and a nozzle plate having nozzle orifices (not shown). It is known to provide printhead 24 with a removable mounting in a carriage assembly in an ink jet printer. The carriage assembly moves printhead 24 in a controlled manner as printhead 24 ejects ink dots therefrom onto paper 30. Printhead 24 may actually be multiple printheads 24 each with a separate color or printhead 24 may have multi-color capability. Printhead 24 is interconnected with controller 26 by way of interconnection 28. Interconnection 28 allows controller 26 to send information to printhead 24 thereby controlling the ink jet dots that are ejected from printhead 24.

Controller 26 is interconnected with printhead 24 by way of interconnection 28; front panel interface device by way of interconnection 32; volatile memory 20 by way of interconnection 34; and nonvolatile memory 18 by way of interconnection 36. Controller 26 is also interconnected with computer 12 by way of interface cable 14. Controller 26 contains the interface hardware and software necessary to communicate with computer 12 or alternatively to communicate with a network in a manner such that imaging device 16 is embodied as a network printer. Controller 26 may be a microprocessor based control system or alternatively a state machine capable of controlling imaging device 16.

Interconnections 28, 32, 34 and 36 may each be separately connected to controller 26 or alternatively all or at least some of interconnections 28, 32, 34 and 36 may be a common bus system.

Now additionally referring to FIG. 2, there is depicted a plurality of processor executable process steps, typically executed in a microprocessor, as more fully described below.

At the point of beginning of the process and specifically at step 102 nonvolatile memory 18 is initialized. Included in the initialization of nonvolatile memory 18, in step 102, a variable TOTAL also known as TOTAL INK CONSUMED is set to zero or a null value. The initializing of nonvolatile memory 18 may be done in a factory environment and may be the state of nonvolatile memory 18 prior to installation in imaging device 16.

Once imaging device 16 is built, the point of beginning of the process is specifically at the point of power up for imaging device 16, that being step 104. At step 104, a variable COUNT is initialized to an initial state, which may be a value of zero. At step 106, controller 26 determines whether an ink drop has been fired from printhead 24. If controller 26 determines that no ink drop has been fired the process returns to step 106. If controller 26 determines that an ink drop has been fired then the process proceeds to step 108.

At step 108, controller 26 increments the variable COUNT, which may, for example, be accomplished by reading COUNT from volatile memory 20, adding one to COUNT and storing the result back into volatile memory 20. At step 110, controller 26 evaluates the value of variable COUNT and compares it with a predetermined number N. If COUNT exceeds or equals predetermined number N then process flow continues to step 112 else process flow returns to step 106.

If at step 110 COUNT equals or exceeds predetermined value N the process continues to step 112. At step 112, variable TOTAL is incremented, which may, for example, be accomplished by controller 26 reading TOTAL from nonvolatile memory 18, adding one to TOTAL and storing the result back into nonvolatile memory 18. The process flow then returns to step 104, which is the point of beginning of the power up start.

Now additionally referring to FIG. 3, there is depicted a plurality of processor executable process steps, typically executed in a microprocessor as more fully described below.

At the point of beginning of the process, and specifically, at step 122, controller 26 determines whether a request for the total ink drops fired in imaging device 16 has been received by controller 26. If controller 26 has received a request for the total ink drops fired in imaging device 16, then the process continues to step 124. At step 124, controller 26 reads variable TOTAL from nonvolatile memory 18 and the process flow continues to step 126.

At step 126, controller 26 multiplies variable TOTAL by predetermined value N resulting in a value that approximates the total number of ink drops fired during the life of imaging device 16. The value thus calculated is then sent to the requesting device by controller 26.

Figure 2:
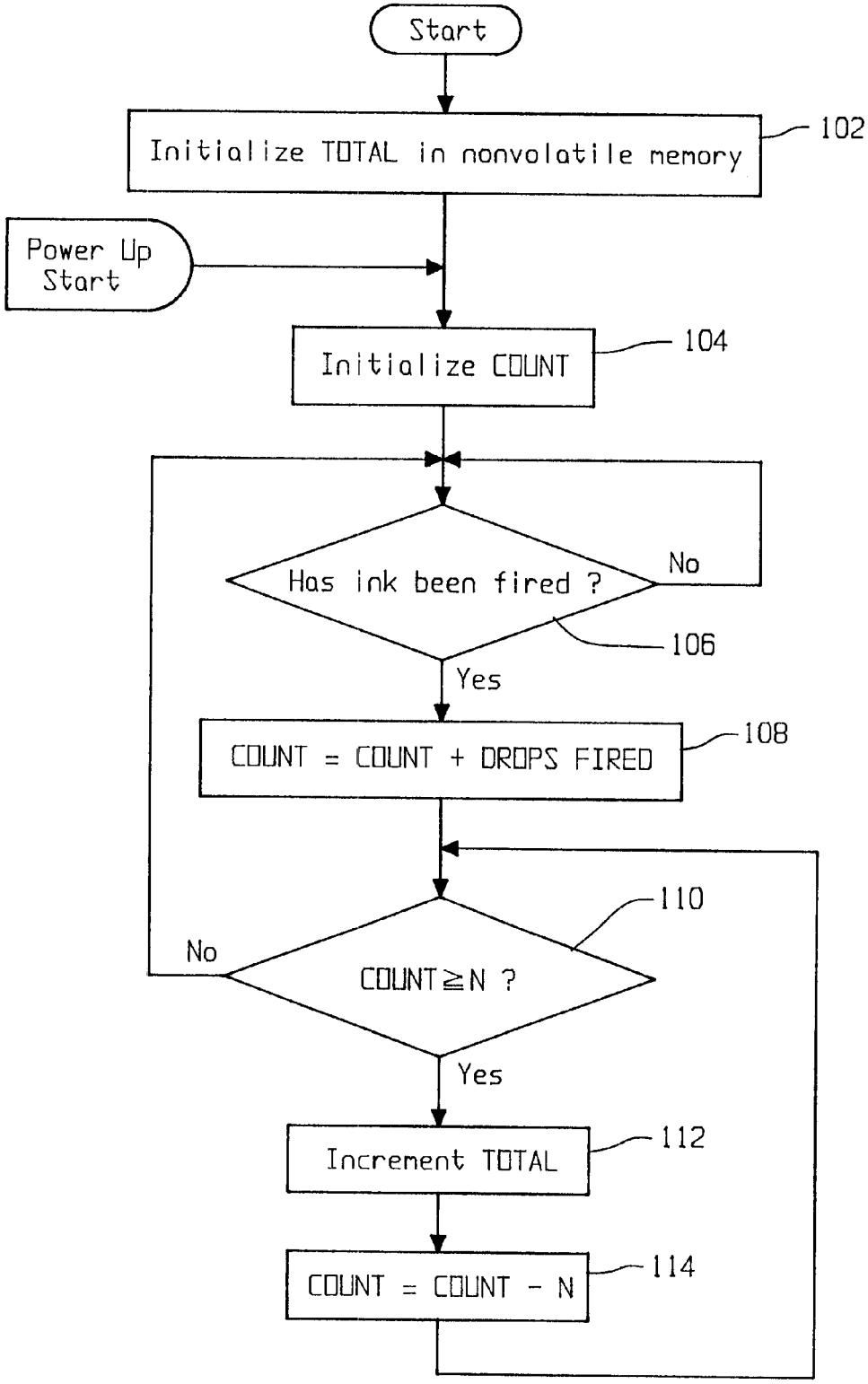
FIG. 2 shows a flow diagram of a process for providing for the storage of a total ink drop fired count for an imaging system shown in FIG. 1.
Figure 3:
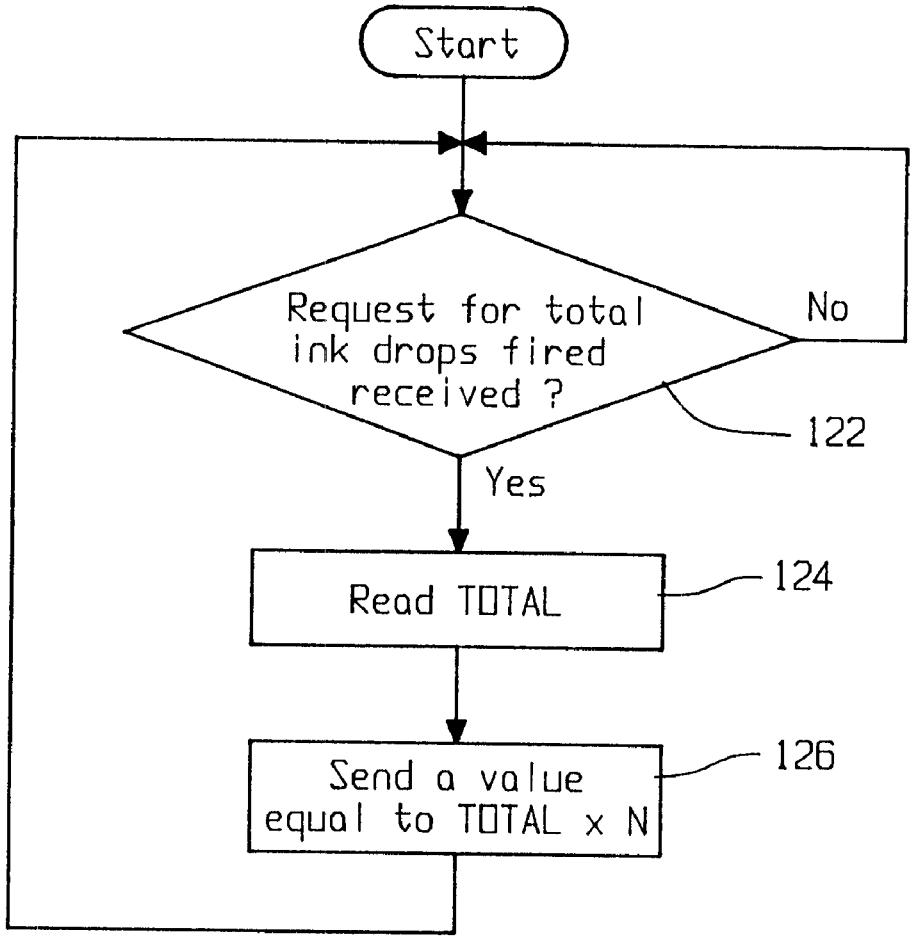
FIG. 3 shows a flow diagram for a process providing information regarding the total ink drop fired count to the imaging system of FIG. 1.

Although the foregoing processes, as depicted in FIGS. 2 and 3, are described without reference to a particular color of ink, the processes are carried out for each color contained in printhead 24 or for each color of each printhead 24 if imaging device 16 has multiple printheads 24 with separate colors in each printhead 24. The implementation of the processes shown in FIGS. 2 and 3, for each color, result in a separate COUNT and a separate TOTAL for each color. This may be accomplished in many ways; for example, an enumerated type of color may be used as an array index, which is utilized in a loop, wherein color is stepped through each of its enumerated elements.

An advantage of the present invention is that variable TOTAL is only incremented when the variable COUNT equals or exceeds predetermined number N, which may be 2,000, thereby allowing TOTAL to represent a significant number of fired ink drops. A further advantage is that this allows a memory space in nonvolatile memory to store a larger maximum number, for example, if the memory space is 32 bits long, that memory space can store a maximum count of $2^{32}-1$, which then would represent $(2^{32}-1)\times 2{,}000$ ink drops fired.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of providing a number approximating a total number of ink drops fired by an imaging device, comprising the steps of:

incrementing a COUNT variable associated with a color of ink if an ink drop of said color is fired by a printhead in said imaging device;

evaluating the value of said COUNT variable; and incrementing a TOTAL INK CONSUMED variable stored in an erasable memory, said TOTAL INK CONSUMED variable being associated with said color, dependent upon said evaluating step.

2. The method of claim 1, further comprising the step of initializing said COUNT variable associated with said color when said TOTAL INK CONSUMED variable associated with said color is incremented.

3. The method of claim 2, wherein said evaluating step includes a step of comparing said COUNT variable to a predetermined number, said incrementing a TOTAL INK CONSUMED variable step being performed if said COUNT variable is one of equal to and greater than said predetermined number.

4. The method of claim 3, further comprising the steps of:

receiving a request from a requesting device for said total number of ink drops fired;

retrieving said TOTAL INK CONSUMED variable; and sending to said requesting device a value equal to said TOTAL INK CONSUMED variable multiplied by said predetermined number.

5. The method of claim 4, wherein said retrieving step and said sending step is repeated for each said color.

6. The method of claim 4, wherein said requesting device includes at least one of a computer and a front panel interface device.

7. The method of claim 1, wherein said erasable memory includes a nonvolatile memory and a volatile memory, said TOTAL INK CONSUMED variable is stored in said nonvolatile memory and said COUNT variable is stored in said volatile memory.

8. The method of claim 1, wherein said imaging device is an ink jet printer.

9. An imaging system, comprising:

a computer; and an imaging device communicatively connected to said computer, said imaging device, comprising:

at least one ink printhead having at least one color of ink;

at least one erasable memory in which is stored at least one TOTAL INK CONSUMED variable associated with a corresponding said at least one color, said at least one erasable memory also storing at least one COUNT variable associated with a corresponding said at least one color; and a controller communicatively connected to said printhead and said at least one erasable memory, said controller incrementing said COUNT variable when said printhead fires an ink drop of said color and said controller incrementing said TOTAL INK CONSUMED variable when said COUNT variable one of equals and exceeds a predetermined number.

10. The system of claim 9, wherein said imaging device is an ink jet printer.

11. The system of claim 9, wherein said at least one erasable memory includes a nonvolatile memory and a volatile memory, each said TOTAL INK CONSUMED variable being stored in said nonvolatile memory and each said COUNT variable being stored in said volatile memory.

12. The system of claim 9, wherein said COUNT variable associated with said color is initialized both when said imaging device is energized and when said TOTAL INK CONSUMED variable associated with said color is incremented.

13. The system of claim 9, further comprising a front panel interface communicatively connected to said controller, one of said front panel interface and said computer requesting said controller to supply a value approximating the total ink drops fired by said imaging device for each said color.

14. The system of claim 13, wherein said controller performs the steps of:

retrieving said TOTAL INK CONSUMED variable from said at least one erasable memory; and sending to one of said front panel interface and said computer a value equal to said TOTAL INK CONSUMED variable multiplied by said predetermined number.

15. The system of claim 14, wherein said controller performs said retrieving and said sending steps for each said color.

16. An imaging device, comprising:

at least one ink printhead having at least one color of ink;

at least one erasable memory in which is stored at least one TOTAL INK CONSUMED variable associated with a corresponding said at least one color, said at least one erasable memory also storing at least one COUNT variable associated with a corresponding said at least one color; and a controller communicatively connected to said printhead and said at least one erasable memory, said controller incrementing said COUNT variable when said printhead fires an ink drop of said color and said controller incrementing said TOTAL INK CONSUMED variable associated with said color when said COUNT variable one of equals and exceeds a predetermined number.

17. The device of claim 16, wherein said imaging device is an ink jet printer.

18. The device of claim 16, wherein said at least one erasable memory includes a nonvolatile memory and a volatile memory, each said TOTAL INK CONSUMED variable being stored in said nonvolatile memory and each said COUNT variable being stored in said volatile memory.

19. The device of claim 16, wherein said COUNT variable associated with said color is initialized both when said device is energized and when said TOTAL INK CONSUMED variable associated with said color is incremented.

20. The device of claim 16, further comprising a front panel interface communicatively connected to said controller, said front panel interface allowing a request to be entered requesting said controller to supply said front panel interface a value approximating the total ink drops fired by said device for each said color.

21. The device of claim 20, wherein said controller is configured to retrieve said TOTAL INK CONSUMED variable from said at least one erasable memory and to send to said front panel interface a value equal to said TOTAL INK CONSUMED variable multiplied by said predetermined number.

22. The device of claim 21, wherein said controller is further configured to retrieve and send said TOTAL INK CONSUMED variable for each said color.

* * * * *